US006933463B2

(12) United States Patent
Yamaguchi et al.

(10) Patent No.: US 6,933,463 B2
(45) Date of Patent: Aug. 23, 2005

(54) MAIN ARC IGNITION DEVICE AND MAIN ARC IGNITION CONTROL METHOD OF PLASMA CUTTING MACHINE

(75) Inventors: Yoshihiro Yamaguchi, Kaga (JP); Takahiro Iriyama, Komatsu (JP); Tetsuya Kabata, Kaga (JP)

(73) Assignee: Komatsu Industries Corp., Tokyo (JP)

( * ) Notice: Subject to any disclaimer, the term of this patent is extended or adjusted under 35 U.S.C. 154(b) by 224 days.

(21) Appl. No.: 10/348,887

(22) Filed: Jan. 22, 2003

(65) Prior Publication Data

US 2003/0141286 A1 Jul. 31, 2003

(30) Foreign Application Priority Data

Jan. 30, 2002 (JP) ..... 2002-021284

(51) Int. Cl.[7] ..... B23K 9/00

(52) U.S. Cl. ..... 219/121.57; 219/121.5; 219/121.39; 219/121.46; 219/121.59; 219/121.51; 219/121.44; 219/121.55

(58) Field of Search ..... 219/121.57, 121.39, 219/121.46, 121.5, 121.44, 121.59, 121.55, 121.51, 74–75

(56) References Cited

U.S. PATENT DOCUMENTS 5,506,384 A * 4/1996 Yamaguchi ..... 219/121.57

FOREIGN PATENT DOCUMENTS

| | | |
|---|---|---|
| JP | 3-258464 A | 11/1991 |
| JP | 5-104251 A | 4/1993 |
| JP | 6-15457 A | 1/1994 |

* cited by examiner

*Primary Examiner*—Shawntina Fuqua
(74) *Attorney, Agent, or Firm*—Frishauf, Holtz, Goodman & Chick, P.C.

(57) ABSTRACT

A main arc ignition method capable of extending lives of a plasma electrode and a nozzle. For this purpose, before or immediately after starting arc, a plasma torch is supplied with a plasma gas at least either at a lower flow rate or at lower gas pressure; the plasma gas is switched to a gas flow rate and gas pressure of a time of cutting a work, after pilot arc is ignited between an electrode and a nozzle, or after main arc is ignited between the electrode and the work; and when generation of the main arc between the electrode and the work is detected, a pilot current is interrupted promptly by a semiconductor switch which is interposed in series with a resistance, in a pilot current circuit that is connected to the nozzle and supplies the pilot current to the pilot arc.

4 Claims, 4 Drawing Sheets

FIG. 2
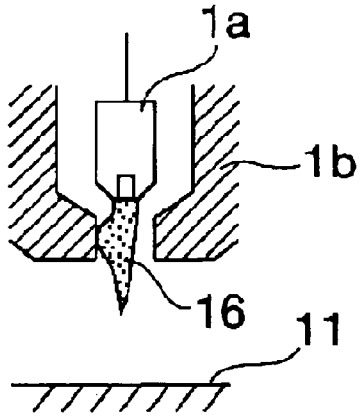
FIG. 3A
FIG. 3B
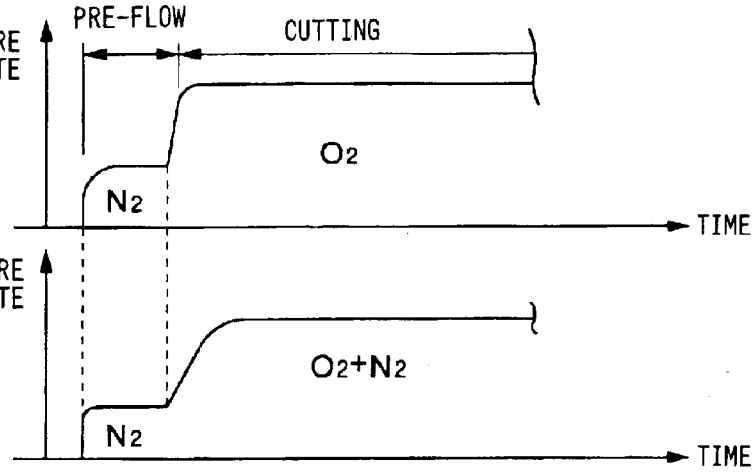

MAIN ARC IGNITION DEVICE AND MAIN ARC IGNITION CONTROL METHOD OF PLASMA CUTTING MACHINE

TECHNICAL FIELD

The present invention relates to a main arc ignition device and a main arc ignition control method of a plasma cutting machine.

BACKGROUND ART

Since deterioration of a plasma electrode and a nozzle directly degrades quality of worked products, and increases running cost on replacing the electrode and the nozzle in plasma arc thermal cutting of a metal plate material (hereinafter, called a work), various research and development conventionally continue to be performed regarding the life of them.

First, to facilitate understanding of the present invention, as a prior art of the plasma cutting machine, the most basic cutting machine using oxygen as a plasma gas and a control method thereof will be explained with reference to FIG. 4A to FIG. 4F which show a general constitution of the plasma cutting machine and a plasma arc starting method, and FIG. 5 which is a time chart of an operation sequence showing an arc starting control method of this plasma cutting machine. In FIG. 4A, the plasma cutting machine includes a plasma power supply (for example, a constant current power supply) 8, a relay box (for example, high frequency generator) 9 which is connected to the constant current power supply 8 by a power supply cable 51, and a plasma torch 1 which is connected to the high frequency generator 9 by a torch cable 52. A work 11, which is connected to the constant current power supply 8 by a base material cable 53 provided in parallel with the power supply cable 51 and the torch cable 52, is cut by plasma arc of the plasma torch 1.

In FIG. 4B and FIG. 5, when a start signal ST is inputted into the plasma cutting machine, the constant current power supply 8 is actuated, then a switch (electromagnetic switch) 14 is closed, and direct-current voltage is applied, so that an electrode 1*a* inside the plasma torch 1 becomes minus, and a nozzle 1*b* and the work 11 become plus. At the same time, a stop valve 15 is opened, and an oxygen gas as pre-flow is supplied into the plasma torch 1. The pre-flow is provided to replace air inside a gas conduit line 4 with oxygen completely, and to obtain sufficient time until a gas flow rate is stabilized.

After the above-described pre-flow, in FIG. 4C, when the high-frequency generator 9 is actuated and high-frequency high voltage is applied between the electrode 1*a* and the nozzle 1*b*, a spark discharge occurs between the electrode 1*a* and the nozzle 1*b*. As shown in FIG. 4D, with this spark discharge as a seed, a pilot arc 16 is formed between the electrode 1*a* and the nozzle 1*b*, a pilot current Ip flows through a circuit from the constant current power supply 8 via a resistance 12, the switch 14, the nozzle 1*b*, the pilot arc 16 and the electrode 1*a* to return to the constant current power supply 8. In this situation, in brief, the constant current power supply 8 is in a state in which it outputs the maximum output power, namely, it functions as substantially the constant current power supply, and therefore the pilot current Ip is given a drooping characteristic by the resistance 12, and is stabilized in a state in which a power supply characteristic and arc voltage are balanced.

As shown in FIG. 4E, when electrical continuity is secured between the electrode 1*a* and the nozzle 1*b* with the pilot arc 16 (see FIG. 4D) as guidance, part of a pilot current Ip becomes a main current Im and flows into the work 11 to form a main arc 13. This is detected with a current detector (not shown), and as shown in FIG. 4F, the switch 14 connected to the nozzle 1*b* is detached, whereby the circuit is only for the main arc 13, and only the main current Im passes through it. A constant current control is performed while comparing an output value of the current detector and the set value to keep a cutting current value previously set (main current Im), and cutting work of the work 11 is carried out. Thereafter, when cutting is finished, a stop signal SP is inputted into the power supply, the output of the power supply is stopped, supply of electric power to the main arc 13 is stopped, and the main arc 13 disappears.

As described above, according to the prior art, the resistance and the switch (electromagnetic switch) are placed in series in the pilot circuit, and after the pilot arc occurs, the main arc is detected by means of the main arc detecting means. Then, according to the detection signal, the switch is opened to interrupt the pilot arc, and the main arc is ignited, which is an art generally adopted in the plasma cutting machines. As for general required time in each process step, the pre-flow in FIG. 4B requires about 2 sec, the time period from the high-frequency high voltage application to the occurrence of spark discharge in FIG. 4C requires about 6 μsec, and the main arc transfer in FIG. 4E requires about 20 to 30 sec.

As a technical challenge in the plasma cutting machines so far, extension of the lives of consumable components is first cited, and a number of inventions are made therefor. As the first prior art, Japanese Patent Laid-open No. 5-104251 is cited. This Laid-open Patent reports that the effect of reduction in electrode consumption is obtained by the art of switching the plasma gas from low gas pressure to high gas pressure, or switching it from a small flow rate to a large flow rate, directly after arc ignition, as the manner of feeding the plasma gas which is supplied to the plasma torch.

Japanese Patent Laid-open No. 3-258464 as the second prior art discloses the art of supplying a non-oxidizing gas to the plasma torch as a plasma gas at the time of starting arc, before or directly after starting arc, and switching the plasma gas to an oxidizing gas after arc ignition. It describes that according to the art of switching the kinds of gas, electrode consumption can be reduced, and the life of the electrode can be extended.

Japanese Patent Laid-open No. 6-15457 as the third prior art describes the art of adopting a transistor instead of an electromagnetic switch as a switch when the pilot arc is interrupted by opening the switch according to the ignition detection signal of the main arc to improve transferability from the pilot arc to the main arc. This art relates to a secondary side chopper control of a pilot current, and the transistor is made to function as a chopper control element, not as a simple switch. The circuit of the main arc outputs full power during occurrence of the pilot arc, and large voltage between the electrode and the base material, or between the nozzle and the base material, which is necessary for the transfer, can be taken sufficiently, therefore making it possible to prevent transfer error and transfer delay to the main arc and provide a favorable power supply device.

The arts related to only the extension of life of electrodes exist conventionally as seen in the aforementioned first and the second prior arts. However, regarding the plasma gas switching of these prior arts, it is recently found out that if the gas is made at a low flow rate or at low pressure at the time of starting, transferability from pilot arc to main arc becomes worse, and a problem of increasing damage of the nozzle occurs. It is found out that transferability to main arc becomes worse with a nitrogen gas or a gas including a lot of nitrogen than with oxygen, and damage is larger to the nozzle. Namely, switching of the gas significantly contributes to an increase in the life of the electrode, but it is found out that it provides no improvement or even an adverse effect concerning the life of the nozzle. Accordingly, even if the life of the electrode is extended, the life of the nozzle terminates before termination of the life of the electrode, and therefore replacement interval of these consumable components does not become long as expected. The fact is that even if this art is adopted and the life the electrode is extended (from about 200 times to about 600 times in the number of arc ignition times), the life of the nozzle is not improved with the number of arc ignition times being about 150 times to 200 times at most.

As the factors responsible for damage to the nozzle, the following two are cited. One is the case caused by a so-called external factor in which molten metal (spatter) that blows toward the nozzle during a piercing process (punching process) adheres to the nozzle, and thereby the nozzle is damaged. The other one is the damage which is caused as a result that an electric current flows into the nozzle by the pilot arc and the outlet port portion of the nozzle is melted by the time of transfer from the pilot arc to the main arc. As the remedial steps for the factors having adverse effects on the life of the nozzle, there is a method of protecting the nozzle from the spatter by providing a shield cap outside the nozzle as to the former external damage, and this method is adopted by most of the plasma torches at present. However, as to the latter damage caused by the pilot arc, clear disclosure of the method of reducing it is not found in the prior arts yet. In short, the art of extending the lives of the electrode and the nozzle at the same time and bring about sufficient practical effects does not exist in the prior art.

As for the life of the nozzle, so long as the life of the electrode does not terminate, the portion in the vicinity of the outlet port of the nozzle is melted by the pilot arc which frequently occurs between the electrode and the nozzle until the transfer to the main arc from the pilot arc is performed, whereby the damage is gradually expanded, normally. Then, the sharpness of the arc is reduced, and at the stage in which the cutting work accuracy is below a predetermined value, it is determined that the life terminates.

Meanwhile, it is known that the temperature of the electrode surface rises up to the high temperature of about 3000° C. at the time of starting arc, and it is instantly consumed in such a manner as the electrode surface is peeled off by the thermal shock at this time. The life of the nozzle is influenced by the life of the electrode. For example, when the electrode reaches some stage of its life, it is abruptly damaged and broken for the aforementioned reason, and at this time, the arc between the electrode and the work in the nozzle, which is thermally cutting the work, is stopped. Then, in place of it, arc between the nozzle and the electrode occurs, and it instantly (on the same principle as that the arc melts the work) melts a portion in the vicinity of the outlet port of the nozzle.

As described above, when an instant damage to the electrode occurs, a so-called accompanying nozzle damage is caused by this. Consequently, the fact is that even when the nozzle still has sufficient sharpness as a nozzle and does not reach the end of the life directly before the damage, it is instantly brought into the state in which it cannot be used continuously. For the above-described reason, from the fact that how many life extension measures are taken for only the life of the nozzle, the life of the nozzle is determined according to the life of the electrode, much attention is paid to the development of the art of extending only the life of the electrodes. Accordingly, it can be said that the idea does not reach the consideration from the viewpoint of relating the nozzle life extension art to the electrode life extension art.

As for the electrodes and the nozzles, the replacement frequencies due to the life span thereof have a tremendous influence not only on the consumption cost accompanying the replacement of the electrode and the nozzle, but also on the reduction in machine availability (productivity reduction), which becomes the problem. To solve the problem, it is ideal to extend the lives of the electrode and the nozzle as long as possible, respectively, and to replace them as a set at the same time (give them the same life span). However, the reality is that the life of the electrode and the life of the nozzle are not the same, and the nozzle life is influenced by an abrupt damage to the electrode as described above, and therefore, their lives cannot help being set to be shorter with an allowance being given.

The adoption of the transistor in the arc ignition art described in the above-described third prior art does not intend extension of the life of the nozzle as described above. In addition, the transistor interposed in the pilot line is used not only as a switch, but a chopper element for adjusting the pilot current. Consequently, a constant current control circuit to control the transistor becomes necessary apart from the constant current control circuit of the main arc current, and the power supply is complicated and the cost is increased.

SUMMARY OF THE INVENTION

The present invention is made in view of the above-described problems, and has its object to provide a main arc ignition device and a main arc ignition control method, which are capable of extending a life of a plasma electrode and a life of a nozzle.

On this invention, the inventors made research and development concerning an optimal ignition control technique of the pilot circuit with the life of the nozzles taken into consideration with respect to the conventional gas switching technique mainly aiming at an increase in the life of the electrode, and obtained the following results.

(1) A damage to the nozzle is caused by a current flowing into the nozzle when the pilot arc is generated, and the magnitude of the current which gives the damage increases as the plasma gas is at lower pressure and at lower flow rate. This shortens the life of the nozzle in the gas switching system which contributes the increase in the life of the electrode.

(2) The current flowing into the nozzle tends to increase in its inflow current value as the gas seed of the plasma gas during pilot arc contains more nitrogen.

(3) Concerning the resistance interposed in series in the pilot line, when the rated pilot arc current value is about 20 A, if the resistance value is less than 2 Ω, the inflow current into the nozzle tends to increase extremely. Consequently, in this case, it is desirable that the resistance value of the pilot circuit is 2 Ω or more.

(4) In order to increase the life of the nozzle, it is preferable to interrupt the pilot circuit immediately once the main current is detected with use of a detection level of the main current which is as low as possible as well as reduce the magnitude of the inflow current into the nozzle, because the damage to the nozzle can be reduced.

(5) Accordingly, the level of the main current detection is set to be low, and after detection, the pilot arc should be interrupted immediately, but if a mechanical open-close switch such as the conventional electromagnetic switch is used, the timing of the interruption is delayed by about 50 msec, and therefore it is desirable to use a semiconductor switch (a transistor, a thyristor, IGBT, and the like). In this case, the semiconductor switch is purely used as a switch, and a chopper control as in the art disclosed in the aforementioned Japanese Patent Laid-open No. 6-15457 is not performed.

By incorporating the results obtained from the research and development as described above, the aforementioned problem concerning extension of the life of the consumable components can be solved, and the achieving means and the effects will be explained below.

In order to attain the above-described object, a main arc ignition device of a plasma cutting machine according to the present invention includes: gas supply means provided with gas switching means which switches at least either a gas flow rate or gas pressure so as to supply a plasma torch with a plasma gas at least either at a lower flow rate or at lower gas pressure as compared with a flow rate and gas pressure of the plasma gas at a time of cutting a work, before or immediately after starting arc; a pilot current circuit which supplies a pilot current to the nozzle from a plasma power supply when pilot arc is formed between an electrode and a nozzle of the plasma torch, at a time of starting the arc; a main current circuit which supplies a main current to main arc from the plasma power supply on forming the main arc between the electrode and the work, at the time of cutting the work; a main current detector which is provided at the main current circuit connected to the work, and detects the main current; and a semiconductor switch which is provided at the pilot current circuit connected to the nozzle, and interrupts the pilot current after the main current detector detects the main current.

According to the above constitution, at first, when the pilot arc is formed between the electrode and the nozzle, the plasma gas which is passed between the electrode and the nozzle before or immediately after starting the arc is made at a low flow rate and/or low gas pressure by the gas switching means. Consequently, a force to blow the pilot arc to the work becomes small, and as a result, the pilot current entering the nozzle easily flows, thus making it possible to form arc even if the pilot current is a small current. On the other hand, it is known that the electrode is instantly consumed in such a manner as the electrode surface is peeled off by the thermal shock when the arc is generated, but the pilot current needs to be only a small current, and therefore damage to the electrode caused by the thermal shock at the time of act ignition can be significantly reduced.

Further, according to the above-described constitution, at the time of cutting the work, after ignition of the pilot arc or the main arc, the plasma gas at the flow rate and the gas pressure for the time of cutting is supplied between the electrode and the nozzle by the gas switching means. Consequently, the force to blow the pilot arc to the work becomes large, and it becomes difficult for the pilot current to flow between the electrode and the nozzle. The current of the plasma power source is branched into the pilot current and the main current, and therefore if the pilot current decreases, the main current increases on the other hand. As a result of this, transfer to the main arc between the electrode and the work from the pilot arc takes place extremely rapidly. The consumption of the electrode caused by the thermal shock by the arc ignition is reduced due to the atmosphere at low gas pressure.

Further, according to the above-described constitution, the transistor is adopted to interrupt the pilot current, and therefore the effect of dramatically extending the life of the nozzle as will be described next can be also obtained in addition to the effect of extending the life of the electrode. Namely, after transfer from the pilot arc to the main arc, part of the arc is still connected between the electrode and the nozzle, and the state in which the pilot current flows into the nozzle continues. Consequently, the outlet port portion of the tip end of the nozzle port is always melted by the arc. Accordingly, in order to extend the life of the nozzle, the time period in which the pilot current flows between the electrode and the nozzle should be as short as possible after transfer to the main arc. In fact, the inventors obtain the fact that the damage to the nozzle by the pilot arc is proportional to the magnitude of the current flowing into the nozzle and the time thereof, from the results of the experiment. Thus, after generation of the main arc, the transistor is adopted in the line of the pilot current circuit, which is connected to the nozzle, instead of the conventional electromagnetic switch to interrupt the pilot current Ip to the nozzle. Consequently, the interruption time of the pilot current is dramatically short as compared with the conventional electromagnetic switch (with respect to about 50 msec of the electromagnetic switch, about 5 msec of the transistor), and the time period in which the outlet portion of the tip end of the nozzle port is always melted by the arc is sharply reduced. This dramatically extends the life of the nozzle by about three times (in the arc ignition times, from about 150 times to 200 times in the prior art to about 600 times) as compared with the prior art.

In the prior art, as an abrupt damage to the electrode due to thermal shock breaks the nozzle in company with the electrode, the life of the electrode and the life of the nozzle are not uniform, and the fact is that a shorter life has to be set with allowance being given. Thus, it is an ideal to extend the life of the electrode and the life of the nozzle to be as long as possible, and replace them as a set at the same time (make them have the same life span). In this regard, according to the above-described constitution, the lives of the electrode and the nozzle can be both increased greatly, and the value of each life can be made substantially the same (about 600 times in the arc ignition times). Consequently, the increase in the lives of the electrode and the nozzle can sharply reduce the replacement frequency due to termination of the life, and tremendous effects can be obtained in improvement of the machine availability (improvement in productivity) not to say improvement in consumable component cost accompanying the replacement. The above-described art of making it possible to extend the life of the electrode and the life of the nozzle at the same time is not a simple combination of the prior arts, but attention is paid to the viewpoint that the life of the nozzle has correlation with the life of the electrode, and how the life of the nozzle is extended at the same time with the extension of the life of the electrode, which is overlooked conventionally, and after devotion to the original idea, the present invention is made.

Further, in the main arc ignition device of the plasma cutting machine, the constitution may include a resistance, which is interposed in series with the semiconductor switch, in the pilot current circuit connected to the nozzle. As described above, the inventors obtain the fact that the damage to the nozzle by the pilot arc is proportional to the magnitude of the current entering the nozzle and the time thereof from the experimental results. The damage to the nozzle is caused by the current which enters the nozzle, and according to the above constitution, the resistance is interposed in the line of the pilot current circuit, which is connected to the nozzle, whereby the pilot current is reduced and the damage to the nozzle can be reduced. In addition, the main current increases on the other hand following the reduction in the pilot current due to the characteristic of the plasma constant current power supply, whereby generation of the main arc, and transfer to the main arc can be performed promptly with stability.

Further, in the main arc ignition device of the plasma cutting machine, the constitution in which a plasma gas, which is supplied to the plasma torch before or immediately after starting arc, is any one of nitrogen, air, or a gas that contains more nitrogen than air may be adopted. Normally, in plasma cutting, vigorous consumption develops in hafnium, which is a electrode material embedded in the center of the electrode, immediately after ignition of the pilot arc. In this constitution, as a plasma gas which is supplied to the periphery of the electrode, nitrogen, air, or a gas, which contains more nitrogen than air, is used. Consequently, nitride of hafnium is formed at a tip end portion of the electrode, and the hafnium nitride has a high melting point, thus making it possible to reduce consumption of the electrode. Accordingly, electrode consumption at the time of starting arc is controlled, and the life of the electrode can be extended.

A main arc ignition control method of a plasma cutting machine according to the present invention includes the steps of: before or immediately after starting arc, supplying a plasma torch with a plasma gas at least either at a lower flow rate or at lower gas pressure as compared with a flow rate and gas pressure of the plasma gas at a time of cutting a work; switching the plasma gas to the gas flow rate and the gas pressure of the time of cutting the work, after pilot arc is ignited between an electrode and a nozzle of the plasma torch, or after main arc is ignited between the electrode and the work; and when detecting generation of the main arc between the electrode and the work, interrupting a pilot current promptly by a semiconductor switch which is interposed in series with a resistance, in a pilot current circuit that is connected to the nozzle and supplies the pilot current to the pilot arc.

According to the above method, the lives of the electrode and the nozzle can be significantly extended in the plasma cutting machine as in the above-described device constitution. Consequently, replacement frequencies of the electrode and the nozzle can be reduced dramatically, and the tremendous effect of increasing machine availability can be obtained, as well as reduction in the consumable component cost accompanying the replacement of the electrode and the nozzle.

BRIEF DESCRIPTION OF THE DRAWINGS

FIG. 2 is a view showing pilot arc according to the embodiment;

FIG. 3A and FIG. 3B are time charts of a plasma gas flow according to the embodiment, FIG. 3A shows a case in which a starting gas is a gas containing pure oxygen or a gas containing much oxygen, and a cutting gas is pure oxygen, and FIG. 3B shows a case in which the starting gas is pure oxygen or a gas containing much oxygen, and the cutting gas is a gas containing much oxygen;

FIG. 4B shows a state in which direct voltage for starting a power supply is applied and supply of a plasma gas is started, FIG. 4C shows a state in which a high frequency high voltage is applied to cause spark discharge, FIG. 4D shows a state in which pilot arc is formed, FIG. 4E shows a state in which main arc is formed, FIG. 4F shows a state in which work cutting is carried out.

BEST MODE FOR CARRYING OUT THE INVENTION

Figure 1:
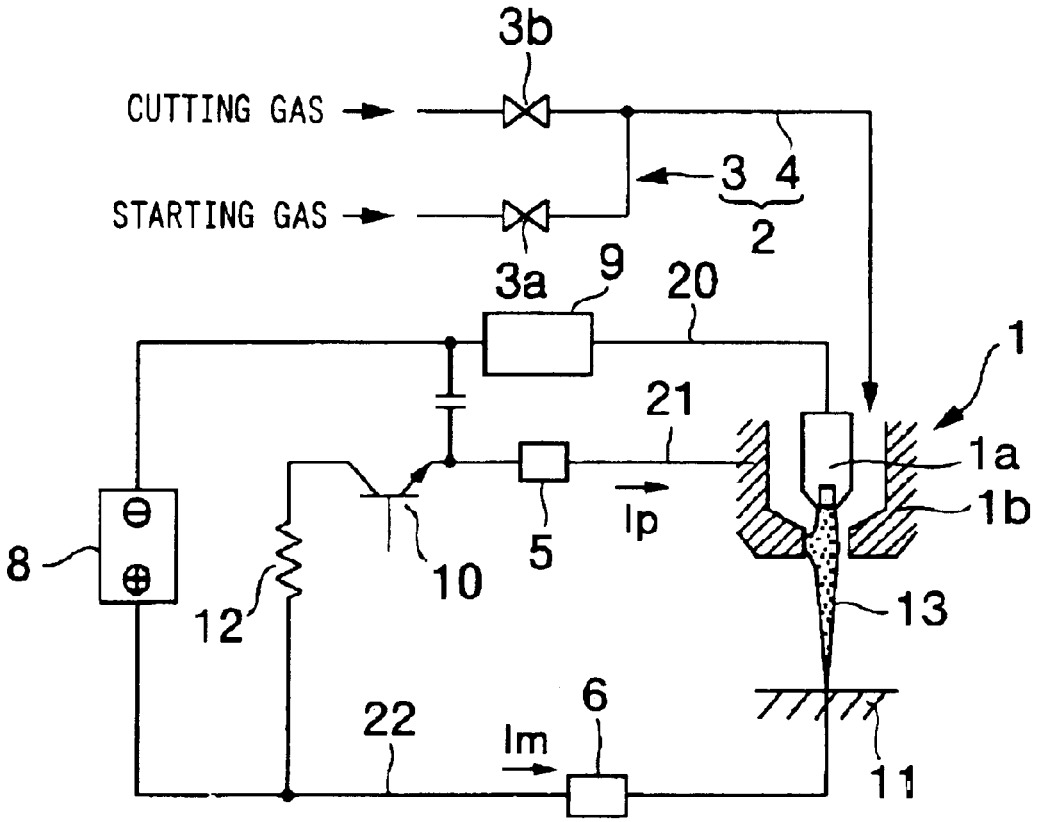
FIG. 1 is a schematic circuit diagram of a main arc ignition device according to an embodiment of the present invention.
Figure 4A:
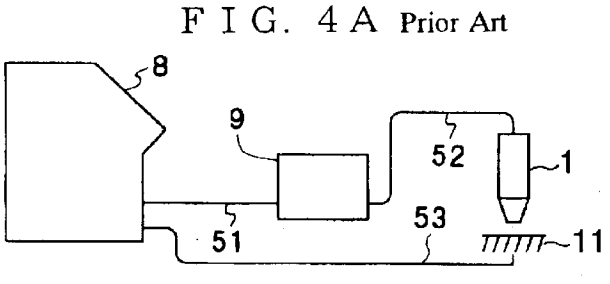
FIG. 4A Prior Art
FIG. 4A is an explanatory view of a general constitution of a plasma cutting machine of a prior art.
Figure 4B:
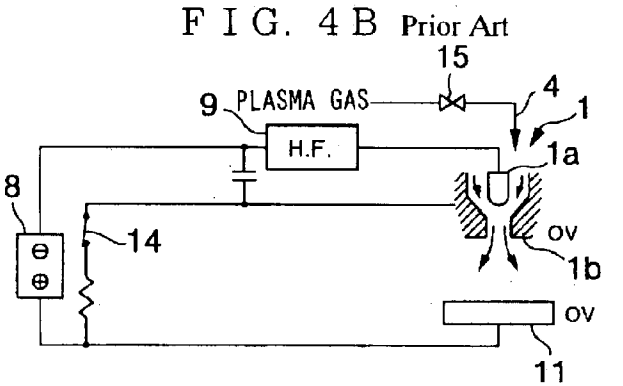
FIG. 4B Prior Art
FIG. 4B to FIG. 4F are explanatory views of a plasma arc starting method of a plasma cutting machine of a prior art.
Figure 4C:
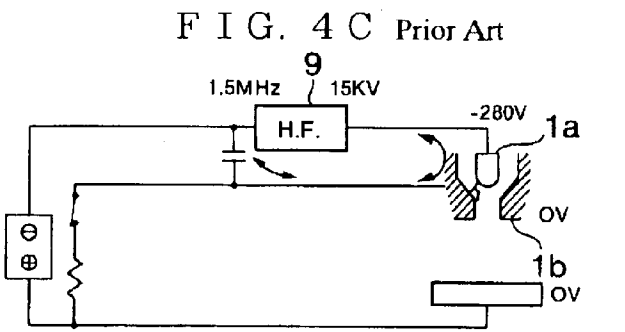
FIG. 4C Prior Art
Figure 4D:
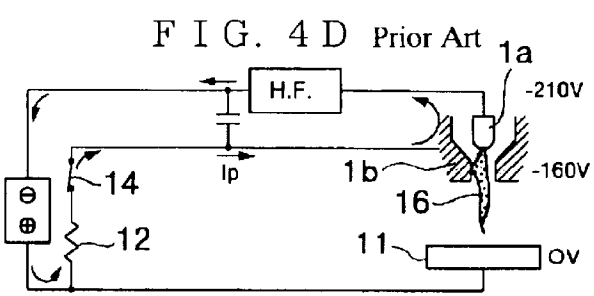
FIG. 4D Prior Art
Figure 4E:
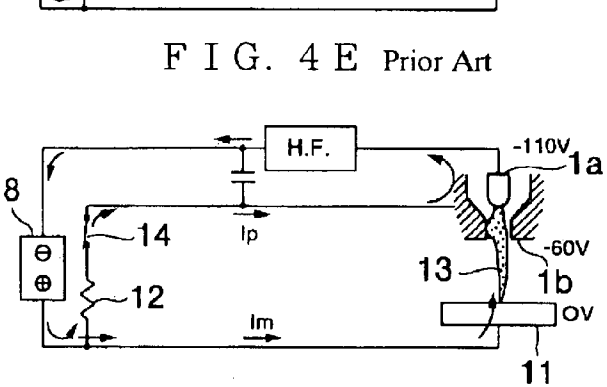
FIG. 4E Prior Art
Figure 4F:
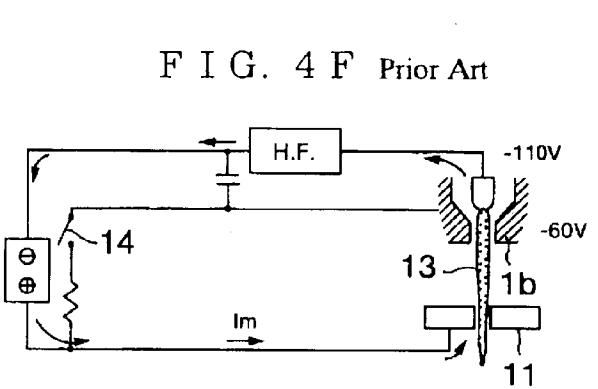
FIG. 4F Prior Art
Figure 5:
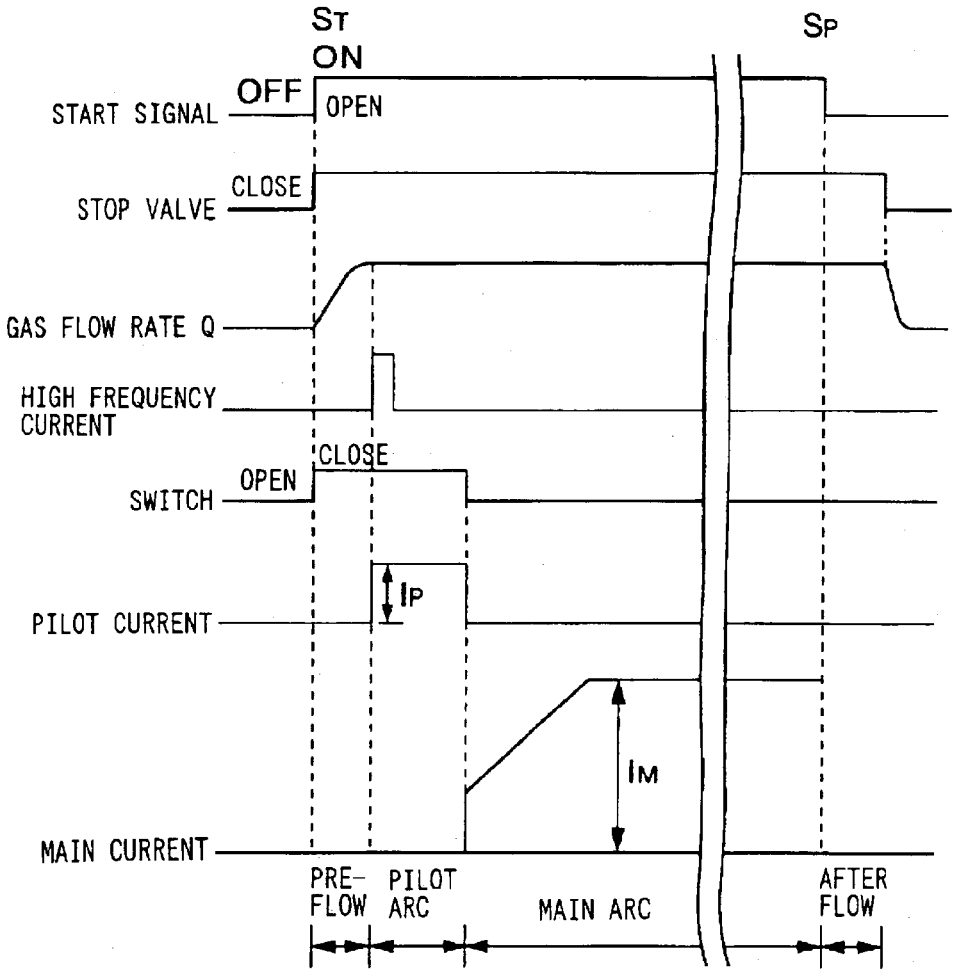
FIG. 5 Prior Art
FIG. 5 is a time chart of an operation sequence showing an arc starting control method of a prior art.

A preferred embodiment of the present invention will be explained in detail below with reference to FIG. 1 to FIG. 3B. The same constitutions as the components in FIG. 4 are given the same reference numerals and symbols, and the explanation in the below will be omitted.

In FIG. 1, a main arc ignition device of a plasma cutting machine includes a constant current power source 8 as a plasma power supply to supply an electric power to a torch 1. A minus output power of the constant current power supply 8 is connected to an electrode 1*a* of a torch 1 via a power supply line 20. A plus output power of the constant current power supply 8 is branched into two system lines: a pilot current circuit 21 which supplies a pilot current Ip, and a main current circuit 22 which supplies a main current Im, which are connected to the nozzle 1*b* and the work 11, respectively. In the pilot current circuit 21, a resistance 12, which transfers a pilot arc 16 (see FIG. 2) that is formed between the electrode 1*a* and the nozzle 1*b* to a main arc 13 that is formed between the electrode 1*a* and the work 11, a transistor 10 for switching, which is the characteristic of the present invention, and a pilot current detector 5, which detects a pilot current Ip flowing between the electrode 1*a* and the nozzle 1*b*, are provided to be connected in series. A control command signal from a controller (not shown) is connected to a base of the transistor 10.

In the experiment performed by the inventors, it is found out that in the case of a cutting machine of the specification of a rated pilot arc current being about 20 A, if a resistance value of the resistance 12 is less than 2 Ω, a current flowing into the nozzle tends to increase extremely, and therefore the resistance value is desired to be 2 Ω or more. According to the results of the experiment, the resistance value is preferably 4 to 8 Ω. As for the transistor 10, the one like an IGBT that operates at a high speed as a switching element is adopted. A surge absorbing circuit (not shown) constituted by diode or the like to absorb a surge at the time of switching may be added to the pilot current circuit 21 as necessary.

Since the main arc 13 shown in FIG. 1 is formed by guidance of the pilot arc 16 shown in FIG. 2, the main current detector 6 to detect that the main current Im flows between the electrode 1*a* and the work his interposed in the main current circuit 22. A current transformer using a shant resistance and a Hall element is used for the main current detector 6, and it is so constituted that when a small current of, for example, about three amperes flows into the main current circuit 22, the transistor 10 of the pilot current circuit 21 is immediately turned off and the pilot current Ip flowing between the electrode 1*a* and the nozzle 1*b* is instantly shut off.

To increase the life of the nozzle, in addition to reduction in the value of the current flowing into the nozzle 1*b*, it is preferable to set a detection level of the main current Im which is as low as possible and interrupt the pilot current circuit 21 immediately, once the main current Im is detected according to the set detection level, because this can reduce the damage to the nozzle. Accordingly, the level of the main current detection is set to be as low as possible and after detection, the pilot arc should be immediately interrupted. In this embodiment, an electronic switch (semiconductor switch) such as a transistor, and an IGBT is used to shorten the timing of this interruption. Consequently, it is confirmed that timing of interruption, which is delayed by about 50 msec in switching of the conventional mechanical contact point, is improved to be about 5 msec, and following this, the life of the nozzle 1*b* as well as the life of the electrode 1*a* is dramatically extended.

The main arc ignition device of this embodiment is provided with gas switching means 3 including a starting gas stop valve 3*a*, which supplies or interrupts the starting gas, and a cutting gas stop valve 3*b*, which supplies or interrupts the cutting gas, and a gas conduit line 4, which connects these starting gas stop valve 3*a* and the cutting gas stop valve 3*b* to the torch, as shown in FIG. 1, as gas supply means 2, which supplies the plasma gas to the torch 1, to increase the life of the electrode 1*a*.

As for switching of these starting gas stop valve 3*a* and the cutting gas stop valve 3*b*, from pre-flow until arc actuation, only the starting gas stop valve 3*a* is opened, and the starting gas is supplied into a gas supply passage which is formed between the electrode 1*a* and the nozzle 1*b* in the torch 1 via the gas conduit line 4. As for the stating gas (pre-flow) at this time, as shown in FIG. 3A and FIG. 3B, it is at low gas pressure and/or a low flow rate as compared with the gas during cutting, and it is pure nitrogen or a gas containing much nitrogen (for example, air, or a gas containing more nitrogen than air).

Next, when the pilot arc 16 occurs between the electrode 1*a* and the nozzle 1*b*, the pilot current detector 5 detects the pilot current Ip flowing between the electrode 1*a* and the nozzle 1*b* through the pilot arc 16, and according to the detection signal, the cutting gas stop valve 3*b* is opened to supply the cutting gas to the plasma torch 1. The cutting gas is at higher gas pressure and/or at a higher flow rate as compared with the starting gas (pre-flow) as shown in FIG. 3A and FIG. 3B, and it is pure oxygen or a gas containing more oxygen than air. It is preferable that the gas containing much oxygen contains 70 volume % or more of oxygen. When the cutting gas stop valve 3*b* is opened, the starting gas stop valve 3*a* may be closed, or it may be kept open if a check valve is interposed in series with the starting gas stop valve 3*a*.

According to this embodiment, the following operation and effects can be obtained.

(1) when the pilot arc is formed between the electrode and the nozzle, a plasma gas flowing therebetween is at a lowl flow rate and/or low gas pressure, and therefore a force to blow the pilot arc to the work is made smaller. As a result, the pilot current Ip flowing into the nozzle easily flows, and even if the pilot current Ip is a small current, it is made possible to form the pilot arc. Only the small pilot current Ip, which passes between the electrode and the nozzle, is needed at the time of pilot arc generation, and therefore the damage to the electrode caused by thermal shock at the time of arc ignition can be sharply reduced.

(2) In the main arc ignition device of the plasma cutting machine, according to the constitution provided with the gas switching means at the gas supply means, a plasma gas at the flow rate and/or the gas pressure for the time of cutting the work is fed between the electrode and the nozzle during cutting. As a result of this, the force to blow the pilot arc to the work becomes large, and it becomes difficult for the pilot current Ip to flow between the electrode and the nozzle. A current of the constant current power supply is branched into the pilot current Ip and the main current Im, and therefore if the pilot current Ip is decreased as described above, the main current Im relatively increases. As the result, occurrence of the main arc between the electrode and the work, and transfer from the pilot arc to the main arc are performed very rapidly. As described above, i) the gas switching means is provided at the gas supply means, ii) the gas is supplied at a low flow rate and/or low gas pressure before or immediately after starting arc, and iii) the gas is switched to be the flow rate and/or gas pressure for the time of cutting after the pilot arc ignition, or after main arc ignition, whereby the life of the electrode of about 600 times in the arc ignition times is secured.

(3) The semiconductor switch such as a transistor is adopted to interrupt the pilot current Ip after the main arc generation. Consequently, the interruption time of the pilot current Ip becomes exceptionally short as compared with the electromagnetic switch as in the prior art (about 5 msec by a transistor with respect to about 50 mse of the electromagnetic switch). Consequently, the time during which the outlet port portion at the tip end of the nozzle port is always melted by the plasma arc is sharply reduced, and therefore the life of the nozzle is dramatically increased to be about three times as long as the prior art (from about 150 times to 200 times of the prior art to about 600 times in the arc ignition times).

(4) The resistance is interposed in the pilot current circuit which is connected to the nozzle, and the resistance value is made 2 Ω or higher, whereby the pilot current Ip to the nozzle is reduced, and the damage to the nozzle can be reduced. With this, the main current Im is increased following the reduction in the pilot current Ip for the aforementioned reason, whereby generation of the main arc and transfer to the main arc can be performed rapidly with stability, and the lives of the nozzle and the electrode can be dramatically extended. Further, as a result of the resistance value being increased, a potential difference between the nozzle and the work is increased, and therefore transfer to the main arc can be facilitated.

(5) In plasma cutting, vigorous consumption is in progress in hafnium being an electrode material embedded in a center of the electrode after pilot arc is ignited at the electrode. However, since nitrogen or the gas containing much nitrogen is used as the plasma gas around the electrode in this embodiment, a nitride of hafnium is formed at a tip end portion of the electrode, and this hafnium nitride has a high melting point, thus making it possible to reduce electrode consumption. Accordingly, the effect of reducing the electrode consumption at the time of starting arc, and extending the life of the electrode can be obtained. An increase in nozzle damage, which is caused by reduction in transferability to the main arc due to the use of nitrogen at the time of starting arc, is eliminated by using the semiconductor switch.

(6) According to the constitution of the present embodiment as describe above, the lives of the electrode and the nozzle can be both increased dramatically, and it becomes possible to make the length of the lives of them substantially the same (about 600 times in the arc ignition times). Consequently, the increase in the lives of the electrode and the nozzle makes it possible to extend the interval of replacement of the electrode and the nozzle by a set, and the replacement frequencies can be sharply reduced. Consequently, tremendous effects can be obtained not only in regard with improvement in the cost of consumable parts but also in improvement in availability of the machine (increase in productivity).

What is claimed is:

1. A main arc ignition device of a plasma cutting machine, comprising:

gas supply means provided with gas switching means which switches at least either a gas flow rate or gas pressure so as to supply a plasma torch with a plasma gas at least either at a lower flow rate or at lower gas pressure as compared with a flow rate and gas pressure of the plasma gas at a time of cutting a work, before or immediately after starting arc;

a pilot current circuit which supplies a pilot current to said nozzle from a plasma power supply when pilot arc is formed between an electrode and a nozzle of said plasma torch, at a time of starting the arc;

a main current circuit which supplies a main current to main arc from said plasma power supply on forming the main arc between said electrode and the work, at the time of cutting the work;

a main current detector which is provided at said main current circuit connected to said work, and detects the main current; and a semiconductor switch which is provided at said pilot current circuit connected to said nozzle, and promptly interrupts the pilot current after said main current detector detects the main current.

2. The main arc ignition device of the plasma cutting machine according to claim 1, further comprising:

a resistance which is interposed in series with said semiconductor switch, in said pilot current circuit connected to said nozzle.

3. The main arc ignition device of the plasma cutting machine according to claim 1, wherein a plasma gas, which is supplied to said plasma torch before or immediately after starting arc, comprises any one of nitrogen, air, or a gas that contains more nitrogen than air.

4. A main arc ignition control method of a plasma cutting machine, comprising the steps of:

before or immediately after starting arc, supplying a plasma torch with a plasma gas at least either at a lower flow rate or at lower gas pressure as compared with a flow rate and gas pressure of the plasma gas at a time of cutting a work;

switching the plasma gas to the gas flow rate and the gas pressure of the time of cutting the work, after pilot arc is ignited between an electrode and a nozzle of said plasma torch, or after main arc is ignited between said electrode and the work; and when detecting generation of the main arc between said electrode and said work, interrupting a pilot current promptly by a semiconductor switch which is interposed in series with a resistance, in a pilot current circuit that is connected to said nozzle and supplies the pilot current to the pilot arc.

* * * * *